US007704201B2

(12) United States Patent
Johnson

(10) Patent No.: US 7,704,201 B2
(45) Date of Patent: Apr. 27, 2010

(54) ENVELOPE-MAKING AID

(75) Inventor: Sara Johnson, Coundon (GB)

(73) Assignee: Sara & Simon Limited, Coundon (GB)

( * ) Notice: Subject to any disclaimer, the term of this patent is extended or adjusted under 35 U.S.C. 154(b) by 0 days.

(21) Appl. No.: 11/664,209

(22) PCT Filed: Jul. 17, 2006

(86) PCT No.: PCT/GB2006/002646

§ 371 (c)(1),
(2), (4) Date: Mar. 29, 2007

(87) PCT Pub. No.: WO2007/010228

PCT Pub. Date: Jan. 25, 2007

(65) Prior Publication Data

US 2007/0254794 A1 Nov. 1, 2007

(30) Foreign Application Priority Data

Jul. 15, 2005 (GB) ..... 0514561.0

(51) Int. Cl.
*B31B 1/25* (2006.01)

(52) U.S. Cl. ..... 493/268; 493/396; 493/397; 493/240; 493/267

(58) Field of Classification Search ..... 493/396, 493/405, 451–453, 455, 457–458, 475–476, 493/397, 953, 188, 240, 243, 267, 268
See application file for complete search history.

(56) References Cited

U.S. PATENT DOCUMENTS

| | | | | |
|---|---|---|---|---|
| 64,537 | A | 5/1867 | Jaeger | |
| 1,153,951 | A | 9/1915 | Plante | |
| 1,221,213 | A * | 4/1917 | Plante | 493/396 |
| 3,633,800 | A * | 1/1972 | Wallace | 223/28 |
| 4,421,500 | A * | 12/1983 | Smith | 493/405 |
| 4,443,198 | A * | 4/1984 | Ehsanipour | 434/153 |
| 4,865,579 | A * | 9/1989 | Kirby et al. | 493/458 |
| 4,936,020 | A * | 6/1990 | Neblett | 33/566 |
| 5,031,332 | A * | 7/1991 | Newman | 33/562 |
| 5,057,070 | A * | 10/1991 | Pidcock | 493/405 |
| 5,156,584 | A * | 10/1992 | Cohen et al. | 493/472 |
| 5,378,222 | A * | 1/1995 | Weber | 493/405 |

(Continued)

FOREIGN PATENT DOCUMENTS

JP 2000/296567 10/2000

OTHER PUBLICATIONS

International Search Report in PCT/GB2006/002646 dated Jan. 5, 2007.

*Primary Examiner*—Christopher Harmon
(74) *Attorney, Agent, or Firm*—Edwards Angell Palmer & Dodge LLP; George N. Chaclas

(57) ABSTRACT

A device useful in the formation of handcrafted envelopes comprises a board (10) with a planar surface (11) wherein the planar surface is provided with at least one guide means (12), and at least one abutting surface (13) that allows an envelope material such as paper or card to be positioned on the planar surface at a defined angle with respect to the guide means such that the paper or card can be folded to the guide means to form an envelope.

29 Claims, 7 Drawing Sheets

U.S. PATENT DOCUMENTS 5,380,265 A * 1/1995 Giovinazzo et al. ..... 493/405
5,518,491 A * 5/1996 Romer et al. ..... 493/231
5,685,816 A 11/1997 Romer
5,842,933 A * 12/1998 Lewis ..... 473/300
5,855,543 A 1/1999 Carbone
6,695,758 B2 * 2/2004 Dostie ..... 493/405
6,708,413 B2 * 3/2004 Carlson et al. ..... 33/27.12

* cited by examiner

ENVELOPE-MAKING AID

CROSS-REFERENCE TO RELATED APPLICATION

This application is the U.S. national phase, pursuant to 35 U.S.C. §371, of international application No. PCT/GB2006/002646, published in English on Jan. 25, 2007 as international publication No. WO 2007/010228 A2, which claims the benefit of British application Ser. No. GB 0514561.0, filed Jul. 15, 2005, the disclosure of which applications are incorporated herein in their entireties by this reference.

BACKGROUND OF THE INVENTION

The present invention relates to a device for use as an aid in the formation of envelopes and a method for using the device. In particular, the invention relates to a device for use in the preparation of handcrafted envelopes.

It is known in the art to provide templates to assist in the preparation of handcrafted envelopes. These products, such as described in U.S. Pat. No. 5,626,551, generally comprise templates that can be used to draw or score the outline of an envelope of predetermined size and shape onto a suitable material, such as paper or card. The paper or card is then cut to the outline and glued to form the envelope. A disadvantage of this template type is that only one size and shape of envelope can be made to each template.

Another known type of envelope-making device comprises a plate that can be used as a guide in the folding process. Using a device of this type, the paper or card is first cut to size using a template and then positioned and folded around the plate to form the envelope. Such a device is described in U.S. Pat. No. 5,685,816, in which a template is combined with two center pieces to produce envelopes. Again, this device is limited by the primary and auxiliary center pieces which dictate the sizes and shapes of the ensuing envelopes.

The present invention identifies the drawbacks of conventional envelope-making devices and techniques and proposes an envelope-making device and method which mitigates one or more of the problems currently associated with envelope-making.

SUMMARY

The present invention in one of its aspects provides an improved enveloping-making device that can be used to produce envelopes of different sizes and shapes.

The aims and objects of the invention will become apparent from reading the following description.

According to a first aspect of the present invention there is provided an envelope-making aid comprising a board defining a planar surface wherein the planar surface is provided with at least one guide means, and at least one abutting surface is provided projecting from the planar surface and wherein an angle substantially at 45 degrees along the planar surface is defined between the guide means and the abutting surface.

The term board is used to mean a piece of substantially flat and substantially solid material. This can include boards of plastic, metal or wood etc.

The term abutting surface is used to mean a surface against which the edges of an envelope material, such as paper or card, can be located so as to correctly position the envelope material with respect to the guide means on the planar surface of the board.

Preferably the envelope-making aid comprises a first abutting surface and a second abutting surface.

Providing multiple abutting surfaces allows multiple edges of the envelope material, e.g. card or paper, to be easily located at the correct positions.

Preferably an angle substantially at 90 degrees along the planar surface is defined between the first abutting surface and the second abutting surface.

As the envelope material will typically be a parallelogram, the 90 degree angle allows for easy location of two sides of the material on the board.

Preferably, the first abutting surface and the second abutting surface are conjoined.

This allows for easy positioning of a corner section of the envelope material.

Optionally, the first abutting surface and the second abutting surface are not conjoined.

Where the first abutting surface and the second abutting surface are not conjoined, the abutting surfaces still facilitate positioning of two edges of the material.

Preferably the board comprises a plurality of guide means.

The guide means act to show the user where to fold the envelope material to produce an envelope.

Preferably, the plurality of guide means is provided along the planar surface of the board such that the guide means are arranged in a parallel fashion.

Preferably the guide means comprises a groove.

Advantageously, providing the guide means in the form of a groove allows the envelope material to be scored along the groove to facilitate subsequent folding. Typically the envelope material can be scored along the guide means by use of a suitable tool such as a craft knife, scissors or scoring blade. The envelope material is preferably paper or card although any suitable material, such as acetate, can also be used.

Optionally, the guide means comprises a double groove.

Advantageously, providing the guide means in the form of a double groove, allows the envelope material to be scored along both of the grooves so that when folded, the envelope material comprises a narrow margin which can be used to produce envelopes of greater depth.

Alternatively the guide means comprises a marked line.

Alternatively the guide means comprises a raised ridge.

Preferably, the board is formed of a plastic material.

Most preferably, the board is formed of Acrylonitrile Butadiene Styrene (ABS).

Alternatively the board is formed of wood.

Optionally the board is formed of any suitable solid material.

Preferably, the board also comprises additional markings to facilitate the envelope-making process.

The additional markings can assist the user in determining the order in which the guide means should be followed with reference to instructions.

More preferably, the additional markings are provided on the abutting surface or surfaces.

Most preferably, the additional markings comprise alphanumeric characters.

Optionally, the additional markings may be provided in Braille.

Optionally, the envelope-making aid can be provided integral with other similar craft aids in a multi-purpose craft device.

Optionally, the envelope-making aid can be provided integral with at least one of a box-making aid and a scoring aid.

According to a second aspect of the invention there is provided a method for making envelopes comprising providing the envelope-making aid according to the first aspect of the present invention, positioning a suitable material on the planar surface of the envelope-making aid such that the edges of the material abut against at least a first abutting surface of the aid, and folding the material along the guide means of the aid to form an envelope.

Preferably the suitable material is paper or card.

According to a third aspect of the invention there is provided a method for making envelopes comprising providing the envelope-making aid according to the first aspect of the present invention, positioning a suitable material on a planar surface of the envelope-making aid such that the edges of the material abut against at least a first abutting surface of the aid, using a suitable scoring tool to score the material along the grooved guide means and folding the material along the scored lines to form an envelope.

According to a fourth aspect of the invention there is provided a substantially flat board having a groove or plurality of substantially parallel grooves in its upper work surface, and at least one edge guide positioned on or against the work surface of the board in angular relationship to the said groove or plurality of substantially parallel grooves, the edge guide having a face that is substantially at right angles to the plane of the board so as to facilitate the location of paper or card onto the work surface and against the face of the edge guide.

Preferably the device includes an edge guide that is releasably positioned on or against the work surface of the board so that it's angular position can be adjusted, in the plane of the board, relative to the groove or plurality of substantially parallel grooves in the work surface of the board.

The device may include a first edge guide and a second edge guide positioned on or against the work surface of the board—the first and second edge guides being positioned in angular relationship to each other and to the groove or plurality of substantially parallel grooves in the work surface of the board, each edge guide having a face that is substantially at right angles to the plane of the board so as to facilitate the location of paper or card onto the work surface and simultaneously against the face of each of the two edge guides.

Preferably the device includes a first edge guide and a second edge guide that are releasably positioned on or against the work surface of the board so that they can be independently adjusted, in the plane of the board, relative to each other and to the groove or plurality of substantially parallel grooves in the work surface of the board.

BRIEF DESCRIPTION OF THE DRAWINGS

Preferred embodiments of the invention will now be described with reference to the accompanying drawings in which.

DETAILED DESCRIPTION OF PREFERRED EMBODIMENTS

Figure 1:
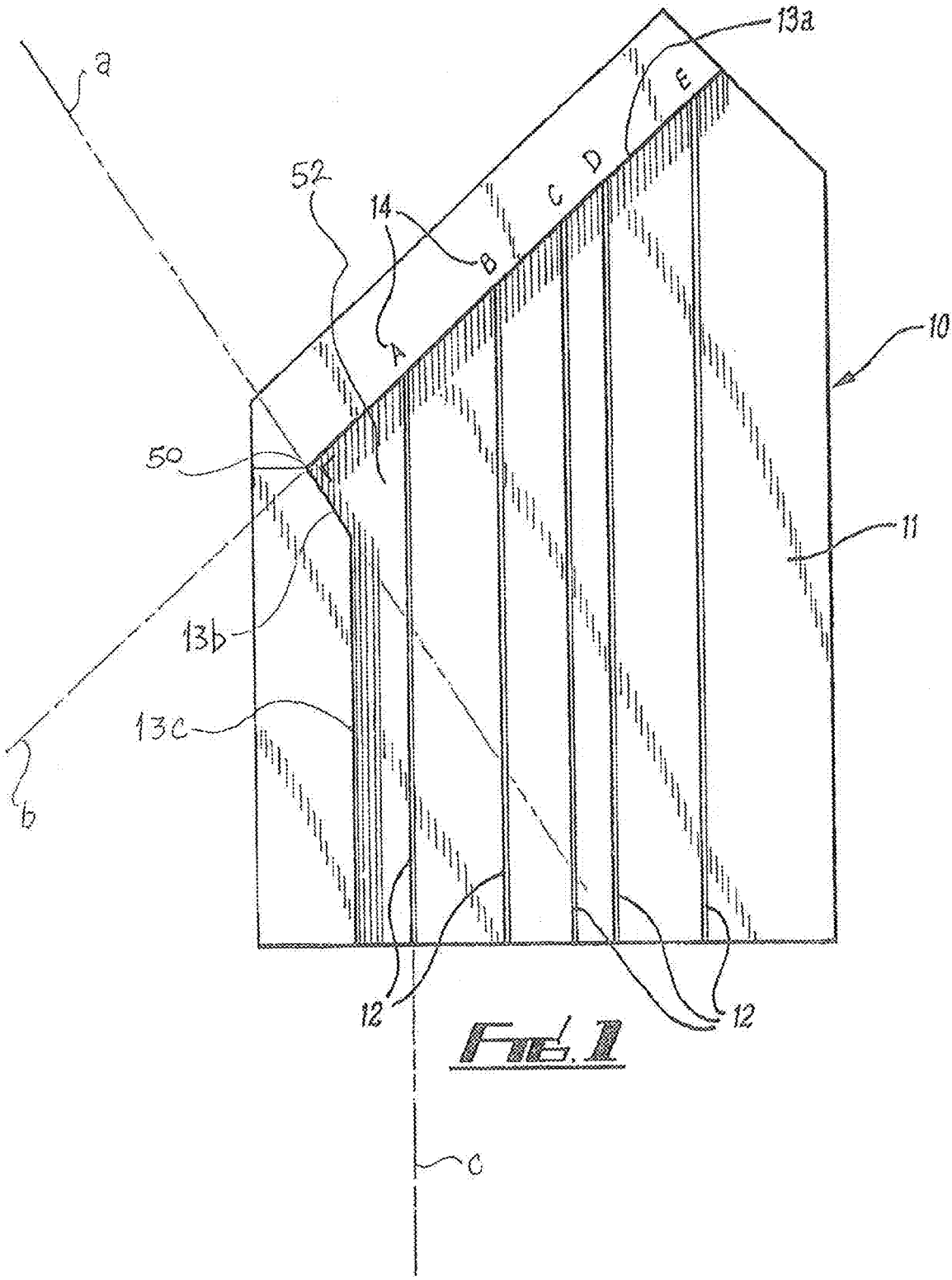
FIG. 1 shows a plan view of the envelope-making aid according to an aspect of the invention.

Referring firstly to FIG. 1, the device comprises a substantially flat board generally depicted at (10) defining a planar surface (11). In use, the envelope material is placed on the planar surface (11) of the board (10). The planar surface is provided with a plurality of guide means (12) in the form of narrow parallel grooves. The narrow grooves allow a suitable scoring tool (not shown) to be run across the envelope material along the trajectory of the groove to create a scored line or crease in the envelope material. The planar surface (11) of the board (10) is provided with a first abutting surface (13*a*) and a second abutting surface (13*b*) which project up from the planar surface. The first abutting surface (13*a*) and the second abutting surface (13*b*) each define an angle substantially at 45 degrees along the planar surface between the guide means (12) and the abutting surface (13*a,b*). The first abutting surface (13*a*) and the second abutting surface (13*b*) define between them an angle of substantially 90 degrees along the planar surface. Additional markings (14) in the form of lettering are provided along the first abutting surface (13*a*) to facilitate instruction of the envelope-making.

At least one envelope folding guide (12) has a longitudinal axis "c". The first abutting surface (13*a*) and the second abutting surface (13*b*) each have a respective axis "a", "b". The axis "a", "b" together converge to a point (50). The axis "a", "b" are also separately bisected by the longitudinal axis "c" of the guide (12) so as to define a closed polygon (50) which is substantially defined on the planar surface (11). As can be seen in FIG. 1, an axis along each guide (12) would form a different closed polygon substantially on the planar surface (12).

While the above description is written in the context of paper as the envelope material it can be envisaged that any suitable material such as card, foil, acetate or light plastic could also be employed.

In use, a piece of suitable envelope material such as paper or card is laid flat along the planar surface (11) of the board (10) such that the edges of the paper abut against the abutting surfaces (13*a,b*) of the board (10). These abutting surfaces (13*a,b*) ensure that the material is kept in the correct position on the board (10) with respect to the guide means (12). Once the envelope material has been correctly positioned, the material is sequentially scored along the appropriate guide means (12) with reference to the instructions provided. After each scoring, the abutting surfaces (13*a,b*) allow the material to be replaced correctly in position on the board (10) so that the subsequent scoring operation can be performed. The material can then be folded against the edges of the abutting surfaces (13*a,b*) to form an envelope.

Advantageously, the plurality of guide means (12) provided at the planar surface (11) allows a variety of envelope sizes and shapes to be formed from a single envelope-making aid. Using the instructions provided with the envelope-making aid, the envelope material can be folded at positions corresponding to various guide means (12) to form envelopes in a variety of different sizes.

Figure 2:
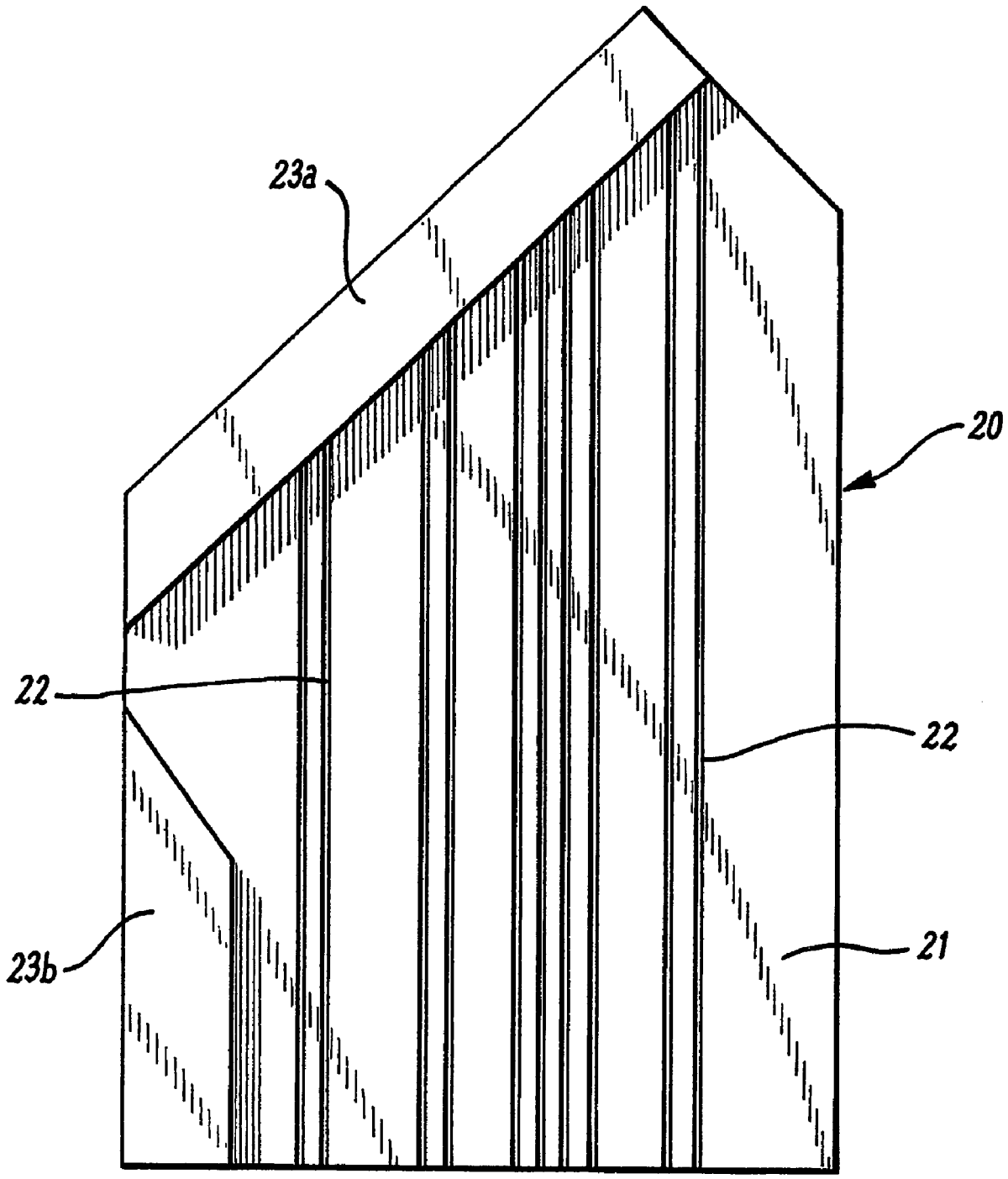
FIG. 2 shows a plan view of an alternative embodiment of the envelope-making aid according to an aspect of the invention.

An alternative embodiment of the invention is depicted in FIG. 2. In this embodiment, the guide means (22) are provided as a series of double narrow grooves. In use, a piece of suitable envelope material is placed along the planar surface (21) of the board (20) as in the previous embodiment such that the edges of the paper abut against the abutting surfaces (23*a,b*) of the board (20). Once the envelope material has been correctly positioned, the material is sequentially scored along the appropriate guide means (22) with reference to the instructions provided. If an envelope of increased depth is required, for example to facilitate an ornate or decoupage greeting card, or a large number of writing sheets, the envelope material is scored along both of the grooves of the appropriate double-grooved guide means (22). This creates a margin or a lip within the material which can be used to form the base of the envelope when folded correctly.

In this second embodiment, the first abutment surface (23*a*) and the second abutment surface (23*b*) are not conjoined. However, the angle defined along the planar surface (21) between the first abutment surface (23*a*) and the guide means (22) is still substantially 45 degrees.

Whilst in the depicted embodiment five guide means (22) are depicted it will be understood that the number of guide means (22) can be adjusted within the scope of the invention to allow a variety of envelopes to be produced. Furthermore, while in the depicted embodiments two abutments surfaces are depicted; it will be evident that an envelope-making aid comprising a single abutment surface or more than two abutment surfaces can also be envisaged under the workings of the invention such as in alternative embodiments described below.

Figure 3:
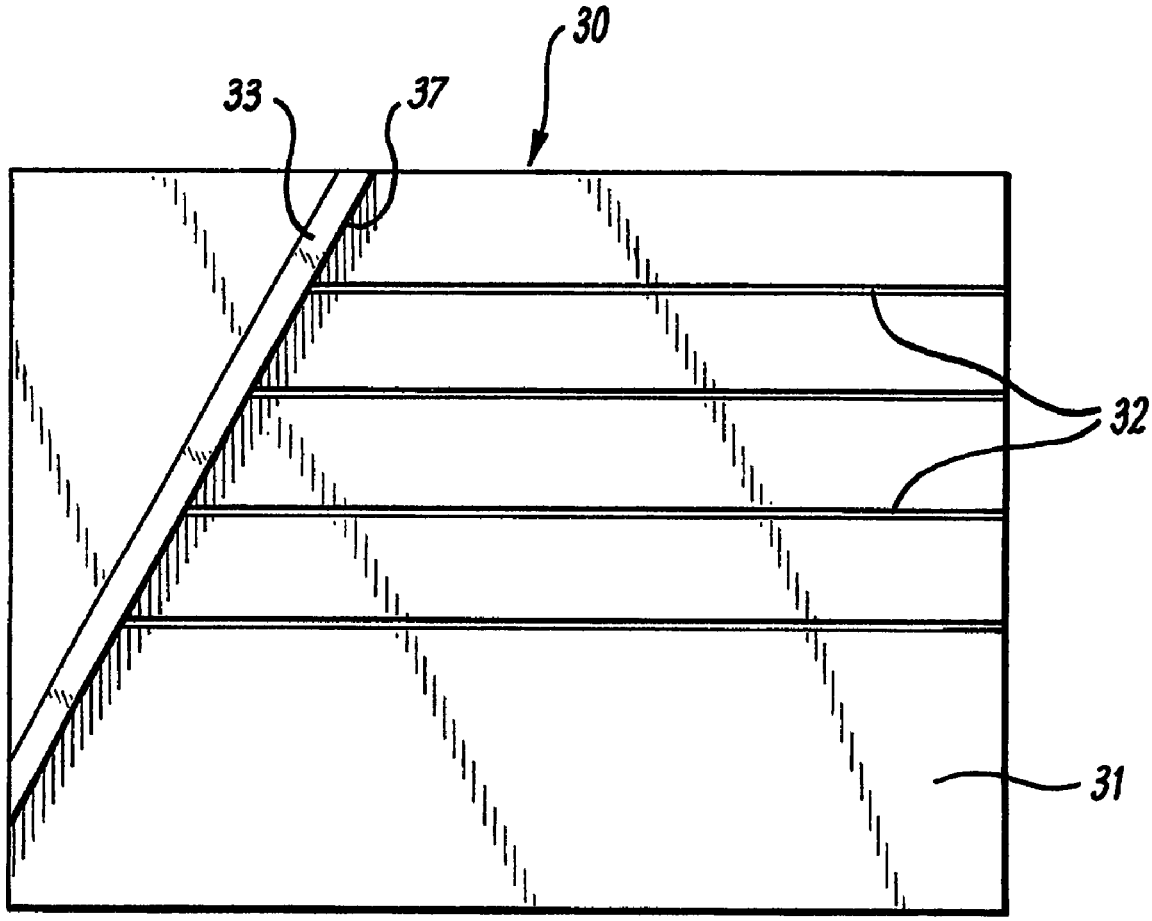
FIG. 3 shows a plan view of a further alternative embodiment of the device.
Figure 4:
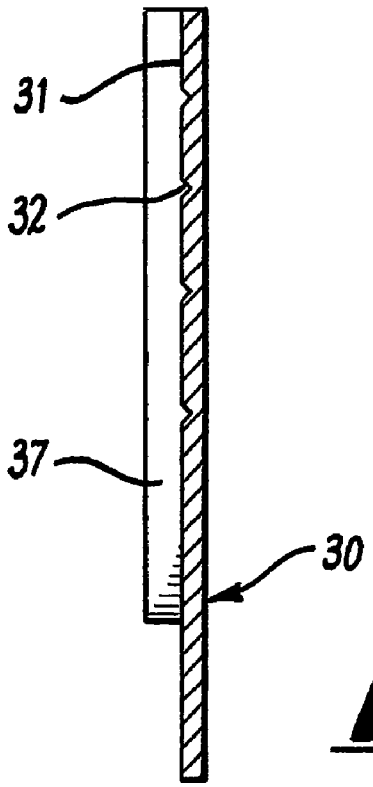
FIG. 4 shows a sectional view (X-X) of the embodiment of FIG. 3.
Figure 5:
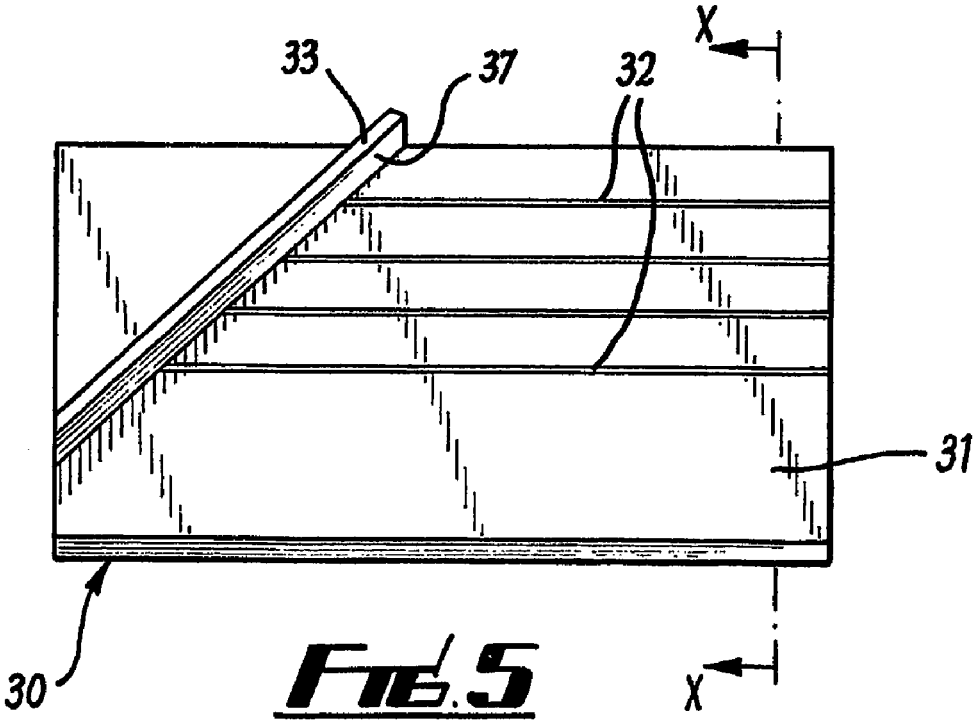
FIG. 5 shows an isometric view of the embodiment of FIG. 3.

Referring now to FIGS. 3, 4 and 5, these Figures show an alternative embodiment of the device where only one abutment surface (31) is provided. The device comprises a board (30) that has a planar or upper work surface (31) in which is provided a plurality of substantially parallel grooves (32). On or against the work surface (31) is positioned an edge guide, or abutment surface (33) having a face (37) that is presented substantially at right angles to the work surface (31), the edge guide (33) being positioned in angular relationship, in the plane of the board, to the single groove or plurality of substantially parallel grooves (32) in the work surface (31). Although in this embodiment the face (37) of the abutment surface is presented at substantially right angles to the work surface (31), it will be understood that the face of the abutment surface can be provided at any angle to the work surface (31) so long as it continues to function as an abutment, and allows for the envelope material to be correctly positioned thereagainst.

Figure 6:
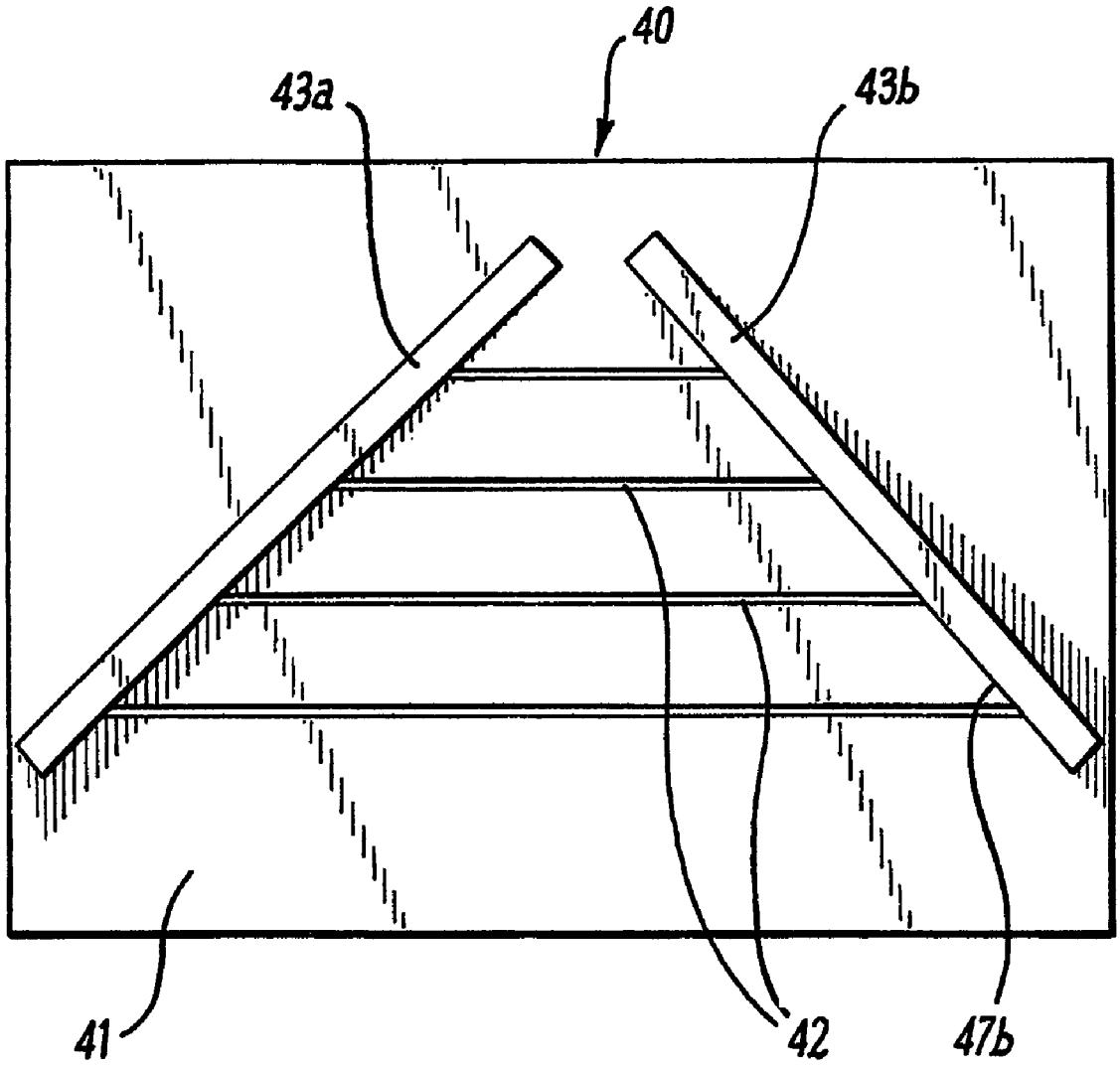
FIG. 6 shows a plan view of a further alternative embodiment of the device.
Figure 7:
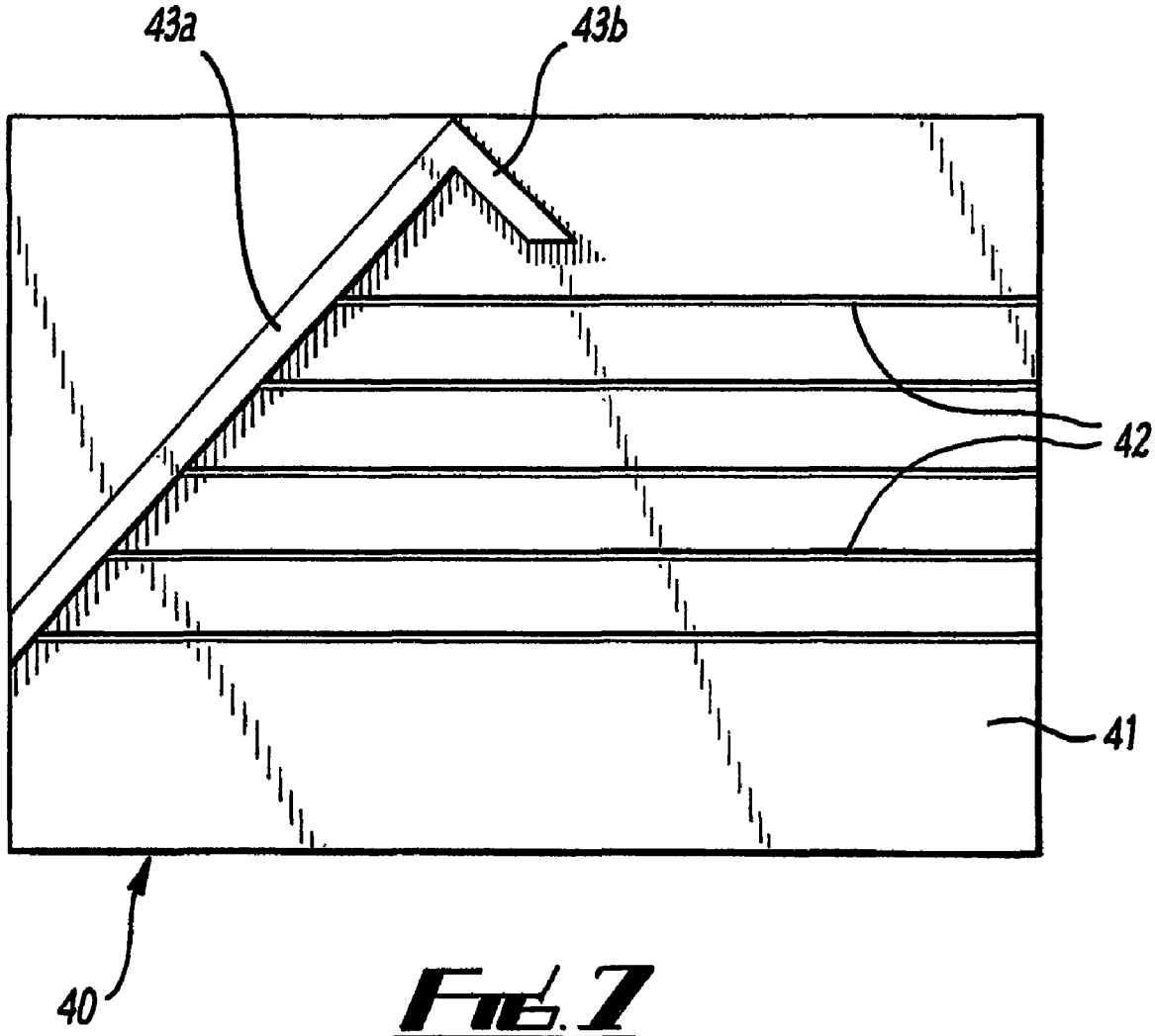
FIG. 7 shows a plan view of yet another embodiment of the device.
Figure 8:
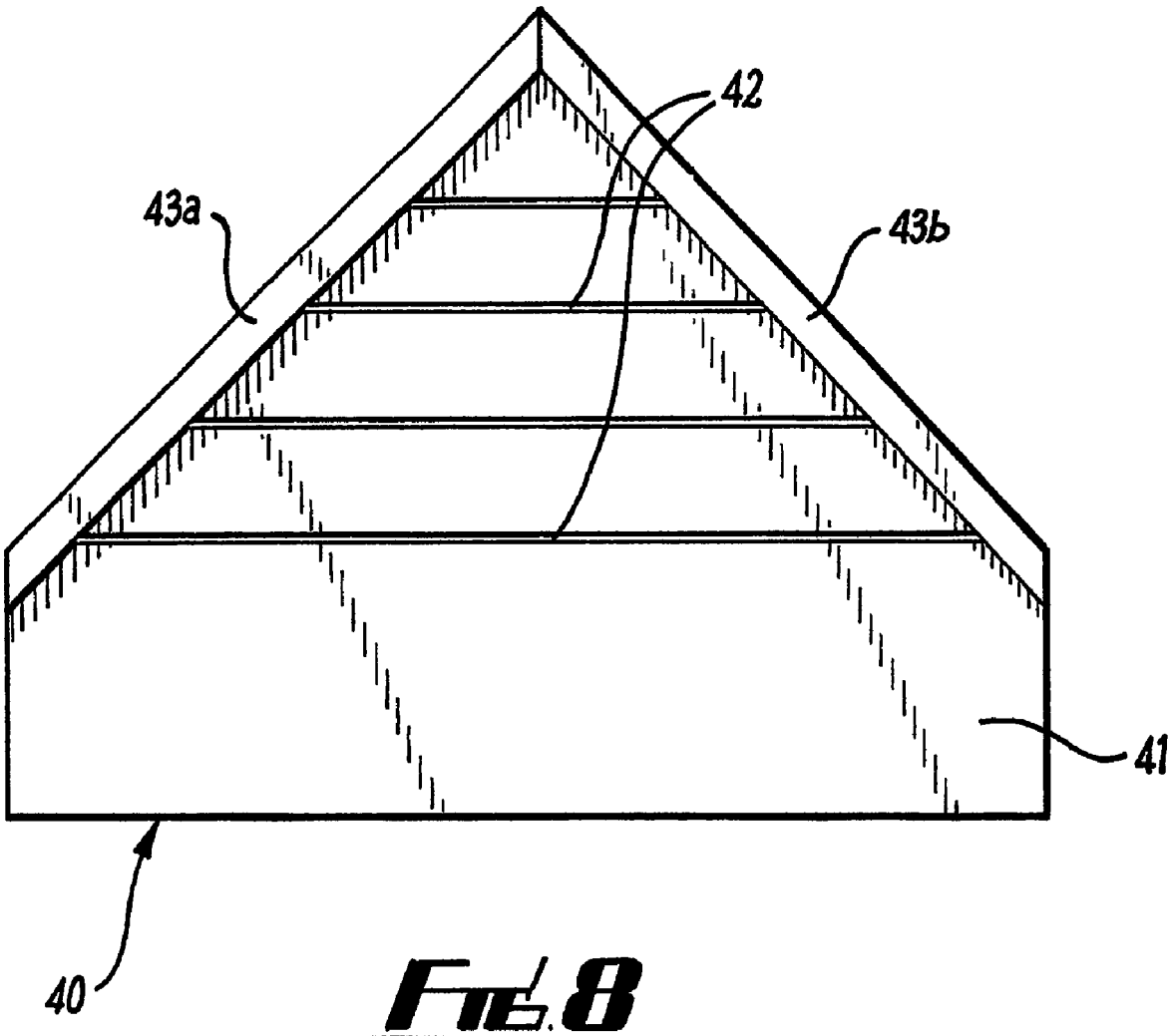
FIG. 8 shows a plan view of another embodiment of the device.

Referring to FIGS. 6, 7 and 8, the device is shown to include a second edge guide (43*b*) positioned in angular relationship to the first edge guide (43*a*) and to the groove or plurality of substantially parallel grooves (42) in the plane of the board, the second edge guide (43*b*) having a face (47*b*) that, as with the first edge guide (43*a*), is presented substantially at right angles to the work surface (41). The purpose of the faces (47*a,b*) is to provide location for one edge or two adjacent edges of the paper or card being scored or creased.

The groove or plurality of grooves (42) in the work surface (41) of the device (40) facilitate the use of a separate scoring tool (not shown) during the creation of a crease or creases in the paper or card. The paper or card to be scored or creased should ideally be of square outline, i.e. with sides of equal length.

The device (10, 20, 30, 40) can be used to create simple handcrafted envelopes of different sizes, depending upon the particular groove or grooves selected by the user, the position of the or each edge guide on relation to the groove or grooves and to each other, and the overall size of the paper or card being used.

It will be evident that various modifications and improvements could be made to the above-described sole within the scope of the invention. For example, the above embodiments depict markings on the abutting surfaces of the board. However, the invention equally encompasses markings on the board in Braille. As another example, the above embodiments depict the guide means as grooves. It will be understood that the guide means can be provided as a marked line or raised ridge and that the envelope material may simply be folded to the guide means without a separate scoring step. Furthermore, while the depicted embodiments describe a stand-alone envelope-making tool, the device can be provided integral with devices that assist handcrafters to produce other handcraft items such as box bases, box lids and greeting cards.

Further modifications may be made without departing from the scope of the invention herein intended.

The invention claimed is:

1. An envelope-making aid comprising a board defining a planar surface wherein the planar surface is provided with at least one envelope folding guide having a longitudinal axis, and a first abutting surface and a second abutting surface each provided projecting from the planar, wherein the first and second abutting surfaces each have an axis which together converge to a point and which axis are each separately bisected by the longitudinal axis of the guide so as to define a closed polygon which is substantially defined on the planar surface and wherein the first and second abutting surfaces ensure that a piece of envelope material placed on the planar surface during an envelope folding process is maintained in correct position with respect to one of the envelope folding guides through simultaneous engagement of edges of the piece in order to fold the envelope material into an envelope.

2. An envelope-making aid as claimed in claim 1, wherein an angle substantially at 90 degrees along the planar surface is defined between the first abutting surface and the second abutting surface.

3. An envelope-making aid as claimed in claim 1, wherein the first abutting surface and the second abutting surface are conjoined.

4. An envelope-making aid as claimed in claim 1, wherein the first abutting surface and the second abutting surface are not conjoined.

5. An envelope-making aid as claimed in claim 1, wherein the board comprises a plurality of envelope folding guide.

6. An envelope-making aid as claimed in claim 1, wherein the envelope folding guide is provided along the planar surface of the board.

7. An envelope-making aid as claimed in claim 5, wherein the plurality of envelope folding guide are arranged in parallel.

8. An envelope-making aid as claimed in claim 1, wherein the envelope folding guide comprises a groove.

9. An envelope-making aid as claimed in claim 1, wherein the envelope folding guide comprises a double groove.

10. An envelope-making aid as claimed in claim 1, wherein the envelope folding guide comprises a marked line.

11. An envelope-making aid as claimed in claim 1, wherein the envelope folding guide comprises a raised ridge.

12. An envelope-making aid as claimed in claim 1, wherein the board is formed of a plastics material.

13. An envelope-making aid as claimed in claim 1, wherein the board is formed of Acrylonitrile Butadiene Styrene (ABS).

14. An envelope-making aid as claimed in claim 1, wherein the board is formed of wood.

15. An envelope-making aid as claimed in claim 1, wherein the board is formed of a rigid solid material.

16. An envelope-making aid as claimed in claim 1, wherein the board also comprises additional markings selected from material positioning marks, material folding marks, material scoring, slitting or cutting marks, sizing or measurement marks, and step-sequence markings to facilitate the envelope-making process.

17. An envelope-making aid as claimed in claim 16, wherein the additional markings are provided on the abutting surface or surfaces.

18. An envelope-making aid as claimed in claim 16, wherein the additional markings comprise alpha-numeric characters.

19. An envelope-making aid as claimed in claim 16, wherein the additional markings are provided in Braille.

20. A method for making envelopes comprising providing the envelope-making aid according to claim 1, positioning a selected material on the planar surface of the envelope-making aid such that the edges of the material abut against the first and second abutting surfaces of the aid, and folding the material along the of the aid to form an envelope.

21. A method for making envelopes comprising providing the envelope-making aid according to claim 1, positioning a selected material on a planar surface of the envelope-making aid such that the edges of the material abut against the first and second abutting surfaces of the aid, using a suitable scoring tool to score the material along the grooved guide and folding the material along the score lines to form an envelope.

22. An envelope making aid comprising a substantially flat board having a groove or plurality of substantially parallel grooves in its upper work surface, and at least one edge guide positioned on or against the work surface of the board in an acute angular relationship to the said groove or plurality of substantially parallel grooves, the edge guide having a face that is substantially at right angles to the plane of the board so as to facilitate the location of paper or card onto the work surface and against the face of the edge guide, and the edge guide being configured to keep said paper or card in a correct position on the work surface with respect to said groove or plurality of substantially parallel grooves during an envelope folding process through simultaneous engagement of an edge of said paper or card in order to fold said paper or card into an envelope.

23. An envelope making aid as claimed in claim 22, wherein the device includes an edge guide that is releasably positioned on or against the work surface of the board so that it's angular position can be adjusted, in the plane of the board, relative to the groove or plurality of substantially parallel grooves in the work surface of the board.

24. An envelope making aid as claimed in claim 22, wherein device includes a first edge guide and a second edge guide positioned on or against the work surface of the board wherein the first and second edge guides are positioned in angular relationship to each other and to the groove or plurality of substantially parallel grooves in the work surface of the board, each edge guide having a face that is substantially at right angles to the plane of the board so as to facilitate the location of paper or card onto the work surface and simultaneously against the face of each of the two edge guides.

25. An envelope making aid as claimed in claim 22, wherein the device includes a first edge guide and a second edge guide that are releasably positioned on or against the work surface of the board so that they can be independently adjusted, in the plane of the board, relative to each other and to the groove or plurality of substantially parallel grooves in the work surface of the board.

26. An envelope-making aid comprising a board defining a planar surface wherein the planar surface is provided with at least one envelope folding guide, and a first abutting surface and a second abutting surface each provided projecting from the planar surface, wherein an internal angle substantially at 45 degrees along the planar surface is defined between the guide and the abutting surfaces and wherein the first and second abutting surfaces are configured to keep a paper or card placed on said planar surface in a correct position on said planar surface with respect to said at least one envelope folding guide during an envelope folding process through simultaneous engagement of edges of the paper or card in order to fold the envelope material into an envelope.

27. An envelope-making aid as recited in claim 26, wherein the envelope folding guide is selected from the group consisting of a groove, a double groove, a marked line, and a raised ridge.

28. A method for making an envelope comprising the steps of:

providing a board defining a planar surface;

providing a first abutting surface and a second abutting surface projecting from the planar surface;

defining at least one envelope folding guide having a longitudinal axis on the planar surface, wherein the first and second abutting surfaces each have an axis which together converge to a point and which axis are each separately bisected by the longitudinal axis of the guide so as to define a closed polygon which is substantially defined on the planar surface; and using the board, first abutting surface, second abutting surface and folding guide to form an envelope from a piece of envelope material;

wherein the first and second abutting surfaces ensure that a piece of envelope material placed on the planar surface during an envelope folding process is maintained in correct position with respect to one of the envelope folding guides through simultaneous engagement of edges of the piece in order to fold the envelope material into an envelope.

29. An envelope-making kit comprising an envelope-making aid comprising a board defining a planar surface wherein the planar surface is provided with at least one envelope folding guide means, and a first and second abutting surface wherein the first and second abutting surfaces each have an axis which together converge to a point and which axis are each separately bisected by the longitudinal axis of the guide means so as to define a closed polygon which is substantially defined on the planar surface, and a scoring tool for creating a crease in a piece of envelope material placed on the planar surface along the at least one envelope folding guide means.

* * * * *